United States Patent [19]

Keppel et al.

[11] 4,351,998

[45] Sep. 28, 1982

[54] MICROWAVE OVEN WITH RESISTANCE HEATING UNIT

[75] Inventors: Heinrich Keppel, Nuremberg; Peter Klapper, Schwabach; Herbert Fleischmann, Nuremberg, all of Fed. Rep. of Germany

[73] Assignee: Licentia Patent-Verwaltungs-GmbH, Frankfurt am Main, Fed. Rep. of Germany

[21] Appl. No.: 208,332

[22] Filed: Nov. 19, 1980

[30] Foreign Application Priority Data

Nov. 20, 1979 [DE] Fed. Rep. of Germany ..... 2946767

[51] Int. Cl.[3] ..... H05B 6/70

[52] U.S. Cl. ..... 219/10.55 R; 126/200; 219/10.55 D; 219/10.55 F

[58] Field of Search ..... 219/10.55 D, 10.55 R, 219/10.55 F, 10.55 M, 10.55 E; 126/200

[56] References Cited

U.S. PATENT DOCUMENTS 3,276,138 10/1966 Fritz ..... 219/10.55 R
3,364,331 1/1968 Johnson ..... 219/10.55 F
3,440,385 4/1969 Smith ..... 219/10.55 R
4,096,369 6/1978 Tanaka et al. ..... 219/10.55 R
4,105,886 8/1978 Baron et al. ..... 219/10.55 R X

*Primary Examiner*—Arthur T. Grimley
*Attorney, Agent, or Firm*—Spencer & Kaye

[57] ABSTRACT

A microwave oven has a cooking chamber; a microwave window in one of the chamber walls; a glass-ceramic plate covering the window; a securing frame affixed to the chamber wall and immobilizing the plate by engaging peripheral portions thereof; a microwave connecting housing adjoining the window externally of the cooking chamber; a microwave generating and guiding device bounding at least in part the space defined by the connecting housing for directing microwave energy into the cooking chamber through the connecting housing and the window; and an electric resistance heater in the cooking chamber. A high-temperature resistant seal is interposed between the securing frame and the plate; the seal is bonded to the chamber wall and the plate. The space defined by the connecting housing is maintained at a pressure which is greater than that prevailing in the cooking chamber.

2 Claims, 2 Drawing Figures

FIG. 1
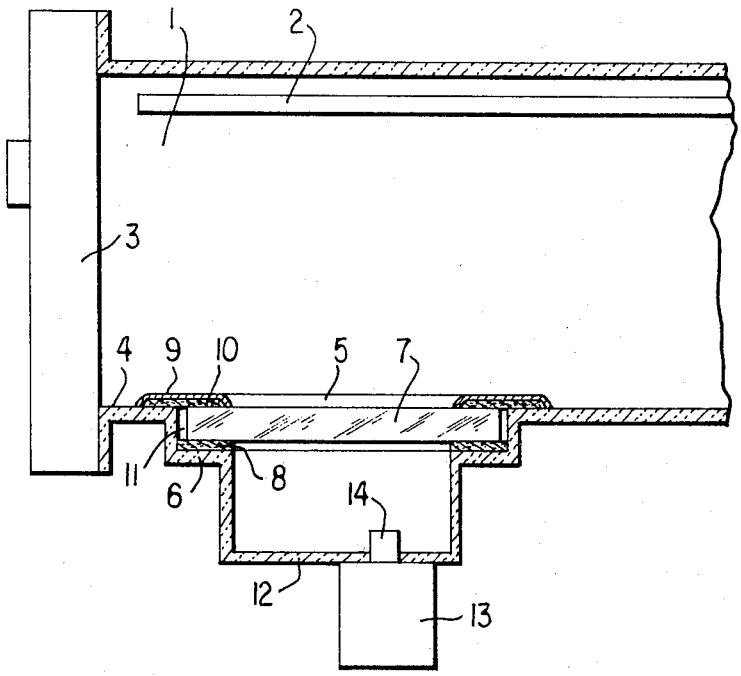
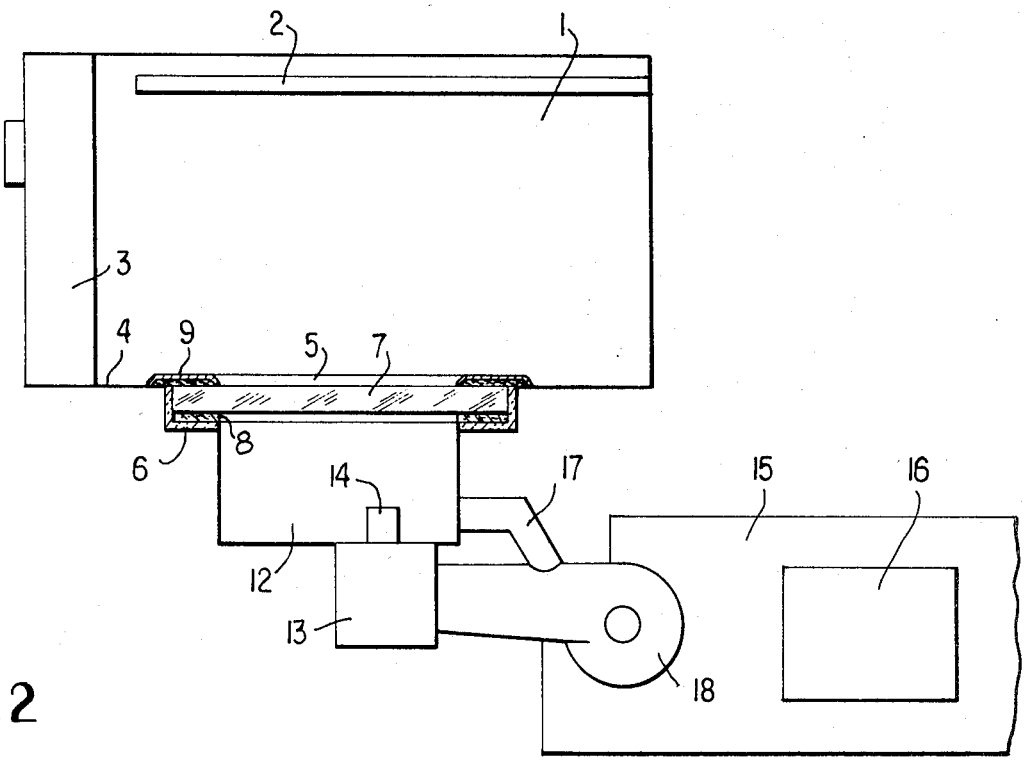
FIG. 2

MICROWAVE OVEN WITH RESISTANCE HEATING UNIT

CROSS-REFERENCE TO RELATED APPLICATION

United States Application Ser. No. 208,333 to Willi Reiss, filed Nov. 19, 1980 discloses related subject matter.

BACKGROUND OF THE INVENTION

This invention relates to a combined oven which operates both on microwave heating and electric resistance heating and which further has a ventilating system as well as a device for the pyrolytic cleaning of the cooking chamber. The bottom of the cooking chamber is provided with a microwave window which is covered by a glass-ceramic plate and below which there are arranged a microwave connecting housing and devices for generating and guiding the microwave energy into the cooking chamber. The glass-ceramic plate is immobilized on the wall of the cooking chamber by means of a circumferential securing frame.

An oven of the above-outlined type is known and is disclosed, for example, in German Offenlegungsschrift (Laid-Open Application) No. 2,715,655. It is known that during cooking, particularly when effected by the conventional resistance heating unit, there is generated a substantial volume of vapor mist which contains in particular grease and egg white particles. From the cooking chamber, where a slight overpressure prevails, the vapor mist penetrates into the smallest cracks and openings in every place within the oven housing. As a result of a subsequent condensation of the vapor mist, components of the oven are soiled to a significant degree. In particular, the risk of such soiling is high regarding the electric or electronic components of the microwave generating apparatus and the waveguide which are practically inaccessible by the user. Consequently, the output of these components is adversely affected by such soiling precipitation and a premature breakdown of the apparatus can be expected.

SUMMARY OF THE INVENTION

It is an object of the invention to provide an improved oven of the above-outlined type in which a penetration of vapor mist from the cooking chamber and thus a precipitation, particularly in the connecting housing and thus on the microwave generating unit and on the waveguide is securely prevented.

This object and others to become apparent as the specification progresses, are accomplished by the invention, according to which, briefly stated, underneath the abovenoted secured frame there is positioned a high-temperature resistant seal which is bonded to the wall of the cooking chamber and to the glass-ceramic plate and further, the space enclosed by the connecting housing is maintained at an overpressure.

By means of sealing the glass-ceramic plate and generating in the connecting housing an overpressure which is greater than the penetration pressure of the vapor mist and gases emanating from the cooking chamber, a penetration of the vapor mist and impure gases through the microwave window into the connecting housing is reliably prevented and consequently a soiling of the components derived from the vapor mist and the impure gases cannot take place. In this manner, the operational reliability and service life of the microwave energy generating device is substantially lengthened and further, the cost of maintenance and upkeep of such combined ovens may be substantially reduced.

BRIEF DESCRIPTION OF THE DRAWING

FIG. 1 is a schematic side elevational view of a cooking chamber of a microwave oven incorporating a part of a preferred embodiment of the invention.

FIG. 2 is a schematic side elevational view of a cooking chamber of a microwave oven including microwave generating components, a cooling system and further incorporating a preferred embodiment of the invention.

DESCRIPTION OF THE PREFERRED EMBODIMENT

Turning now to the Figures, the cooking chamber 1 of an oven not shown in more detail has, on its top side, a conventional tubular electric resistance heating unit 2. The cooking chamber 1 which may be closed in front by an oven door 3, has a bottom 4 provided with a microwave opening (window), 5 having, for example, a rectangular outline. The opening 5 is defined by a circumferential flange 6 arranged in a sunken relationship with respect to the bottom 4. The opening 5 is closed off toward the cooking chamber 1 by means of a glass-ceramic plate 7 that reposes on the flange 6. Between the flange 6 and the glass-ceramic plate 7 there is provided a high-temperature resistant sealing element 8 made, for example, of a highly fire-resistant ceramic fiber. The glass-ceramic plate 7 lying on the sealing element 8 is immobilized in its sunken position by a circumferential securing frame 9 which is affixed to the bottom 4 of the cooking chamber 1 by means of screws.

The securing frame 9 is supported on the bottom 4 of the cooling chamber 1 with interposition of an elastic, high-temperature resistant seal 10 which is airtight, grease tight and liquid tight. Further, the securing frame 9 engages that surface of the glass-ceramic plate 7 which is oriented toward the cooking chamber 1. Advantageously, the seal 10 is bonded to both the bottom 4 of the cooking chamber 1 and the glass-ceramic plate 7 by means of an appropriate adhesive. Between the glass-ceramic plate 7 and a raised edge 6' of the flange 6 there is formed a clearance 11 which is overlapped by the seal 10 and which provides for a free expansion and contraction of the glass-ceramic plate 7. Underneath the glass-ceramic plate 7, in the zone of the opening 5, there is arranged a bowl-shaped connecting housing 12, the cross-sectional dimensions of which generally correspond to that of the opening 5.

A magnetron 13 arranged at the outside of the housing 12 serves for generating microwave energy. An antenna 14 projecting into the housing 12 emits the microwaves which are guided through the glass-ceramic plate 7 into the cooking chamber 1. For cooling the magnetron 13 there is provided a blower 18 associated with a ventilating system 15 which passes through the oven housing and which serves for the cooling of additional electric components 16.

The connecting housing 12 communicates with the blower 18 by means of a pressure conduit 17, so that in the housing 12 a pressure prevails which affects the underside of the glass-ceramic plate 7. Thus, in the connecting housing 12 a pressure is generated which is greater than the pressure in the cooking chamber 1 and which therefore prevents a penetration of impure gases or vapors through the sealed zone of the glass-ceramic plate 7. The prevailing overpressure, in cooperation with the two particular sealing elements 8 and 10 of the glass-ceramic plate 7 ensures in the housing situated underneath the glass-ceramic plate 7 a best possible protection of the microwave energy generating and guiding devices against condensation precipitation from vapors or impure gases.

It will be understood that the above description of the present invention is susceptible to various modifications, changes and adaptations, and the same are intended to be comprehended within the meaning and range of equivalents of the appended claims.

What is claimed is:

1. In an oven including walls defining a cooking chamber; means defining a microwave window in one of said walls; a glass-ceramic plate covering said window; a securing frame affixed to said one wall and immobilizing said plate by engaging peripheral portions thereof; a microwave connecting housing adjoining said window externally of said cooking chamber; microwave generating and guiding means bounding at least in part the space defined by said connecting housing for directing microwave energy into said cooking chamber through said connecting housing and said window; and electric resistance heating means operatively connected with said cooking chamber; the improvement comprising (a) a high-temperature resistant seal interposed between said securing frame and said plate; said seal being bonded to said one wall and said plate;

(b) a cooling system for ventilating the oven; the cooling system including pressure means for circulating air; said pressure means having a pressure side; and (c) a conduit maintaining communication between said pressure side and said space defined by said connecting housing for maintaining said space at an overpressure that is greater than the pressure prevailing in said cooking chamber.

2. An oven as defined in claim 1, further comprising an additional seal interposed between said plate and a wall portion supporting said plate; said wall portion surrounding said window.

* * * * *